US005478411A

United States Patent [19]

Coey et al.

[11] Patent Number: 5,478,411

[45] Date of Patent: Dec. 26, 1995

[54] MAGNETIC MATERIALS AND PROCESSES FOR THEIR PRODUCTION

[75] Inventors: John M. D. Coey; Hong Sun; David P. Hurley, all of Dublin, Ireland

[73] Assignee: Provost, Fellows and Scholars of the College of the Holy and Undivided Trinity of Queen Elizabeth Near Dublin, Dublin, Ireland

[21] Appl. No.: 260,667

[22] Filed: Jun. 16, 1994

Related U.S. Application Data

[63] Continuation of Ser. No. 812,115, Dec. 20, 1991, abandoned.

[30] Foreign Application Priority Data

| | | | |
|---|---|---|---|
| Dec. 21, 1990 | [IE] | Ireland | 4644/90 |
| Feb. 28, 1991 | [IE] | Ireland | 671/91 |
| Sep. 18, 1991 | [IE] | Ireland | 3281/91 |

[51] Int. Cl.[6] ..... H01F 1/058

[52] U.S. Cl. ..... 148/122; 148/102

[58] Field of Search ..... 148/122, 102

[56] References Cited

U.S. PATENT DOCUMENTS

| | | | |
|---|---|---|---|
| 2,779,699 | 1/1957 | Langworthy | 148/122 |
| 3,219,495 | 11/1965 | Steinort | 148/101 |
| 4,402,770 | 9/1983 | Koon | 148/302 |
| 4,753,675 | 6/1988 | Ovshinsky et al. | 75/0.5 |
| 4,837,114 | 6/1989 | Hamada et al. | 148/101 |
| 4,894,098 | 1/1990 | Otomo et al. | 148/122 |
| 5,122,203 | 6/1992 | Bogatin | 148/301 |
| 5,129,964 | 7/1992 | Anderson | 148/104 |
| 5,194,099 | 3/1993 | Esper et al. | 148/302 |

FOREIGN PATENT DOCUMENTS

| | | | |
|---|---|---|---|
| 0101552 | 2/1984 | European Pat. Off. . | |
| 0108474 | 5/1984 | European Pat. Off. . | |
| 0106948 | 5/1984 | European Pat. Off. . | |
| 0190461 | 8/1986 | European Pat. Off. . | |
| 0320064 | 6/1989 | European Pat. Off. . | |
| 0334445 | 9/1989 | European Pat. Off. . | |
| 0344018 | 11/1989 | European Pat. Off. . | |
| 0356279 | 2/1990 | European Pat. Off. . | |
| 0369097 | 5/1990 | European Pat. Off. . | |
| 0397264 | 11/1990 | European Pat. Off. . | |
| 55-67110 | 5/1980 | Japan . | |
| 60-144909A | 7/1985 | Japan . | |
| 60-176202A | 9/1985 | Japan . | |
| 61-263201A | 11/1986 | Japan . | |
| 2-133517 | 5/1990 | Japan | 148/122 |

OTHER PUBLICATIONS

Higano et al., *Magnetic Properties of RE–TM–N System*, IEEE Transactions on Magnetics, vol. 23, No. 5, (Sep. 1987) pp. 3098–3100.

Chemical Abstracts, CA–103–219192t (JP–A–60–131949)—Hitachi Metals Ltd. (Jul. 13, 1985).

Abstract (JP–A–63–103599)—TDK Corp. (Jan. 25, 1990).

Chemical Abstract No. 109–121365a (JP–A–62–269303)—Inoue–Japax Research Inc. (Nov. 21, 1987).

*Primary Examiner*—John Sheehan

*Attorney, Agent, or Firm*—Kinney & Lange

[57] ABSTRACT

A process is provided for modifying the magnetic properties of an intermetallic compound comprising at least iron, or a combination of iron with at least one transition metal, and at least one rare earth element. The process comprises heating the intermetallic compound in a reaction gas containing at least one element of groups IIIA, IVA or VIA of the Periodic Table in the gaseous phase to interstitially incorporate the element or elements of these groups into the crystal lattice of the intermetallic compound. Novel magnetic materials showing easy uniaxial anisotropy, increased spontaneous magnetization and Curie temperatures are produced by the process.

33 Claims, 10 Drawing Sheets

MAGNETIC MATERIALS AND PROCESSES FOR THEIR PRODUCTION

This is a file wrapper continuation of U.S. application Ser. No. 07/812,115, filed Dec. 20, 1991 now abandoned.

BACKGROUND OF THE INVENTION

The invention relates to a process for producing magnetic materials, to new and improved materials produced thereby and to the use of these materials to make permanent magnets.

Magnets have many applications in engineering and science as components of apparatus such as electric motors, electric generators, focussing elements, lifting mechanisms, locks, levitation devices, anti-friction mounts and so on. In order for a magnetic material to be useful for making a permanent magnet three intrinsic properties are of critical importance. These are the Curie temperature (Tc) i.e. the temperature at which a permanent magnet loses its magnetism, the spontaneous magnetic moment per unit volume ($M_s$) and the easy uniaxial anisotropy conventionally represented by an anisotropy field $B_a$. The Curie temperature is of particular significance because it dictates the temperature below which apparatus containing the magnet must be operated.

During this century much research has been directed to developing magnetic materials which combine high Curie temperatures and improved magnetic moments with strong uniaxial anisotropy. For many years magnetic materials of the AlNiCo type were used in permanent magnets for practical applications. In the late 1960's it was discovered that alloys of the rare earth elements, particularly samarium when alloyed with cobalt, had magnetic properties which made them superior as permanent magnets to the AlNiCo type. Compounds of samarium and cobalt provided magnets which were particularly successful in many demanding practical applications requiring a magnet with a high energy product. However the high cost of cobalt as a raw material led investigators in the early 1980's to consider the possibility of combining the cheaper and more abundant iron with the magnetically superior rare earth elements to produce permanent magnets with improved magnetic properties. A major breakthrough came in 1983 when the Sumitomo Special Metals Company. and General Motors of America independently developed a magnetic material which combined a rare earth element and iron and incorporated a third element, boron, into the crystal lattice to give an intermetallic compound, $Nd_2Fe_{14}B$ which can be used to produce magnets with an excellent energy product, but a lower Curie temperature than the Sm-Co materials. These Nd-Fe-B magnetic materials can have a Curie temperature of up to 320° C. and are particularly described in three European applications, EP-A-0101552, EP-A-0106948 and EP-A-0108474. Derivatives of these boride materials represent the state of the art to date in magnet technology. However they are somewhat unstable in air and change chemically, gradually losing their magnetic properties so that despite Curie temperatures in excess of 300° C. in practice they are not suitable for operating at temperatures greater than 150° C.

The fact that the incorporation of boron into the crystal lattice of intermetallic materials containing a rare earth element and iron serves to improve magnetic properties has encouraged investigators to search for new compounds of elements other than boron in combination with rare earth elements and iron.

In EP-A-0320064 hard magnetic materials are described containing neodymium and iron but having carbon incorporated to give compounds of the formula $Nd_2Fe_{14}C$ having a similar crystal structure to the known boride materials. In EP-A-0334445 variations of the above type of material having carbon incorporated are described in which neodymium is replaced with praseodymium, cerium or lanthanum and the iron is partly substituted with manganese. Finally EP-A-0397264 describes compounds of the formula $RE_2Fe_{17}C$ where RE is a combination of rare earth elements of which at least 70% must be samarium. The preferred compound described in the last of the above three patent applications, which has carbon interstitially incorporated into a $Sm_2Fe_{17}$ crystal lattice, demonstrates improved Curie temperatures and uniaxial magnetic anisotropy. However it is produced by arc melting of the constituent elements to obtain a casting which is then subjected to an annealing treatment at very high temperatures (900°–1100° C.) in an inert gas. Using such a process puts a limitation on the amount of additional elements which can be interstitially incorporated.

A process for bringing about interstitial incorporation of an element of group VA of the Chemical Abstract Service (CAS) Periodic Table (all references made herein to the "Periodic Table" are being made to the CAS Periodic Table) into intermetallic compounds containing one or more rare earth elements and iron has already been developed by the present inventors and is described in the Applicants' copending European Patent Application No 91303442.7 which process comprises heating the intermetallic starting material in a gas containing the group VA element in the substantial absence of oxygen.

SUMMARY OF THE INVENTION

The present invention is a magnetic material consisting essentially of at least one rare earth element, iron or a combination of iron with one or more transition metals, a stabilizing element and one or more of the elements of groups IIIA, IVA, or VIA of the periodic table having the following general formula:

$$R(T_{n-x}M_x)Zy$$

where N is approximately 12 and wherein $0.5<x<3.0$ and $0.1<y<$ or $>1.0$.

The present invention further includes a process of modifying the magnetic properties of an intermetallic compound comprising at least iron, or a combination of iron with at least one transition metal and at least one rare earth element. The process of the present invention comprises heating said intermetallic compound and a reaction gas containing at least one element selected from the group consisting essentially of groups IIIA, IVA or VIA of the CAS periodic table in the gaseous phase. The element or elements of group IIIA, IVA or VIA are interstitially incorporated into the crystal lattice of said inner metallic compound forming a modified magnetic compound with improved properties.

The novel magnetic materials of the present invention show easy uniaxial anisotropy, increased spontaneous magnetization and increased Curie temperatures.

BRIEF DESCRIPTION OF THE DRAWINGS

FIG. 1(*b*) shows the tetragonal crystal structure of $Nd(Fe_{11}Ti)Cy$ showing the 2b site occupied by carbon.

FIG. 2 shows: (b) X-ray defraction patterns of $Sm_2Fe_{17}$ powder after treatment in methane for two hours at 550° C.; and FIG. 2 shows: (c) X-ray defraction patterns of $Sm_2Fe_{17}$ powder after treatment and orientation in a magnetic field of 0.3T.

DETAILED DESCRIPTION OF THE PREFERRED EMBODIMENTS

Figure 1B:
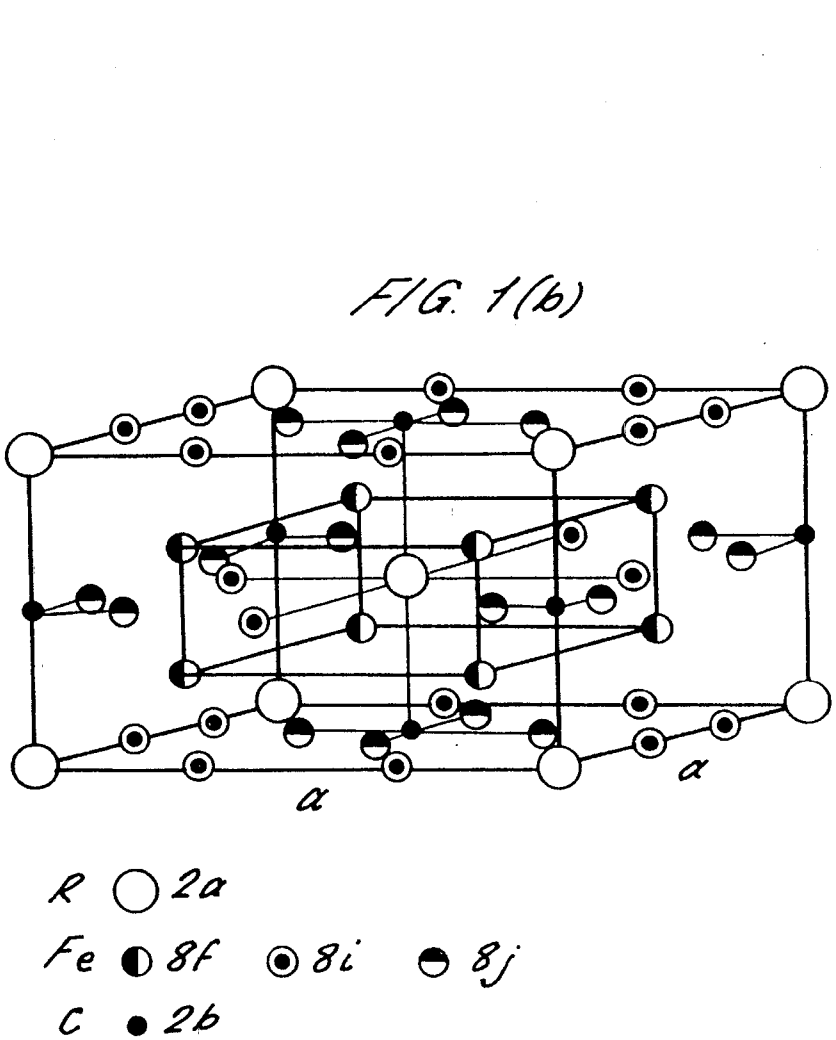
FIG. 1(*a*) shows the rhombohedral crystal structure of $Sm_2Fe_{17}Cy'$ where the 9e site is occupied by carbon.

A process has now been developed which permits interstitial incorporation of elements of groups IIIA, IVA and VIA of the Periodic Table into the rare-earth/iron type compounds to produce novel materials having improved magnetic properties with regard to Curie temperatures (Tc), spontaneous magnetic moment per unit volume (Ms) and easy uniaxial anisotropy (Ba). Such materials are suitable for further processing to make permanent magnets with a large energy product exceeding 80 $kJ/m^3$.

A process for modifying the magnetic properties of an intermetallic compound comprising at least iron, or a combination of iron with at least one transition metal, and at least one rare earth element comprises heating said intermetallic compound in a reaction gas containing at least one element of groups IIIA, IVA or VIA of the Periodic Table in the gaseous phase to interstitially incorporate said element or elements of groups IIIA, IVA or VIA into the crystal lattice of said intermetallic compound.

It is to be understood that herein the term rare earth element also includes the elements yttrium, thorium, hafnium and zirconium and that groups IIIA, IVA and VIA of the Periodic Table are those defined by the CAS version of that table, i.e. Group IIIA, B, Al, Ga, In, Tl, Group IVA, C, Si, Ge, Sn, Pb; Group VIA O, S, Se, Te, Po.

The intermetallic compounds which may be modified by the process of the invention include those of the $ThMn_{12}$ type with a tetragonal crystal structure and those of the $Th_2Ni_{17}$ or $ThZn_{17}$ type having hexagonal or rhombohedral crystal structures respectively. Those of the crystal structure type $BaCd_{11}$ and $CaCu_5$ may also be modified by the process.

In one embodiment of the invention the intermetallic starting materials heated in a reaction gas in accordance with the process of the invention may be tetragonal compounds of the general formula:

$$R(T_{n-x}M_x)$$

in which R is at least one rare earth element as herein defined, T is iron or a combination of iron with one or more transition metals, M is an element that serves to stabilise the structure-type, n is approximately 12 and $0.5<x<3.0$.

Preferred components for R are yttrium, cerium, praseodymium, neodymium, samarium, gadolinium, terbium, dysprosium, holmium, erbium, thulium or lutetium or a mixture of two or more thereof. Particuarly preferred compounds are those where R is praseodymium or neodymium such as for example $PrFe_{11}Ti$ or $NdFe_{11}Ti$ or compounds where praseodymium or neodymium are combined with another rare earth element. For example in a compound such as $NdFe_{11}Ti$ some of the neodymium can be substituted with cerium to reduce cost or substituted with a heavy rare earth such as terbium or dysprosium to improve uniaxial anisotropy.

In compounds of the formula $R(T_{n-x}M_x)$ described above the iron may be in combination with a transition metal such as cobalt, nickel or manganese. In particular the iron may be substituted with up to 45% cobalt.

The stabilizing element M is preferably an early transition metal such as those of groups IVB, VB and VIB of the Periodic Table. Particularly preferred stabilizing elements are titanium, vanadium, molybdenum, tungsten or chromium.

In another embodiment of the invention the intermetallic starting material which is heated in a reaction gas in accordance with the process of the invention may be a hexagonal or rhombohedral compound of the general formula:

$$R'_2(T'_{n-x}M'_x)$$

in which R' is at least one rare earth element, T' is iron, M' is one or more transition metals, n is approximately 17 and $0\leqq x'<6.0$.

Preferred components for R' for these hexagonal or rhombohedral starting materials are yttrium, cerium, praseodymium, neodymium, samarium, gadolinium, terbium, dysposium, holmium, erbium, thulium or lutetium or a mixture of two or more thereof and particularly preferred are those compounds where R is samarium such as for example $SmFe_{17}$ or where R is samarium partially substituted with neodymium, praseodymium or cerium.

Further, a transition metal M' may substitute for the iron such as cobalt, nickel or manganese.

In yet another embodiment of the invention the intermetallic starting materials may be of the tetragonal crystal structure type $BaCd_{11}$ for example $RFe_5Co_4M''$ where M' is a stabilizing element such as silicon or of the crystal structure type $CaCu_5$, for example $RCo_3FeM'''$ where M''' is a stabilizing element such as boron.

The preferred group IIIA, IVA or VIA elements which may be interstitially incorporated into the crystal lattice of the intermetallic compounds of tetragonal, rhombohedral or hexagonal crystal structure described above are boron in Group IIIA, one or more of carbon, silicon and germanium in Group IVA or one or more of sulphur, selenium and tellurium in Group VIA.

Optionally the interstitially incorporated element may be combined with hydrogen.

The elements of Groups IIIA, IVA or VIA which are interstitially incorporated, whether or not in combination with hydrogen, will hereinafter be designated Z.

Thus in accordance with another aspect of the invention there are provided novel magnetic materials of the general formula:

$$R(T_{n-x}M_x)Z_y$$

wherein R, T, x, M and Z are as herein defined and $0.1<y\leqq 1.0$.

The invention also provides compounds of the general formula:

$$R'_2(T'_{n-x'}M'_{x'})Z_{y'}$$

wherein R', T', M', Z and x' are as herein defined and $0.5<y'<3.0$. Particularly preferred examples of these latter compounds are those where $y'>1.5$.

The invention further provides compounds of the formula $RTCo_{n-x''}M''_{x''}Z_{y''}$ where R,T,Z and M" are as hereinbefore defined, n is 11 $1<x''<3$ and $0<y''<1$ and also compounds of the formula $RCo_3FeM'''Z$ where R and Z are as hereinbefore defined and M''' is a stabilizing element such as boron.

The precise formula of the novel materials will depend upon the starting materials, which of course may have all the variations already discussed herein, and the element or elements of Group IIIA, IVA or VIA of the Periodic Table which are present in the reaction gas.

For example, if the element Z is to be carbon then the reaction gas may be a hydrocarbon such as methane, any $C_2$ to $C_5$ alkane, alkene or alkyne or an aromatic hydrocarbon such as benzene. If the element Z is to be boron the reaction gas may be a boron containing gas such as borane, diborane or decaborane vapour. If the element Z is silicon then the reaction gas may be a silane and if the element Z is sulphur the reaction gas may be hydrogen sulphide. The reaction gas may be mixed with an inert carrier gas such as helium or argon.

Particularly preferred magnetic materials are those where the interstitially incorporated element is carbon such as, for example $Sm_2Fe_{17}C_{y'}$ where $y'>2.0$ and more preferably $y=2.5$ or $NdFe_{11}TiC_y$ and $PrFe_{11}TiC_y$ where $0.5<y\leqq 1.0$, preferably $0.6<y<0.9$ and more preferably $y=0.8$.

Other preferred magnetic materials are those where the interstitially incorporated element is boron such as $Sm_2Fe_{17}B_{y'}$ where $y'>1.5$.

To carry out the process of the invention an ingot of the rare earth/iron intermetallic starting material is preferably crushed to a fine powder having a particle size of less than 50 microns diameter. Such a powder may be optionally prepared by mechanical alloying. The powder is then placed in a suitable reactor vessel which is evaporated and filled with the reaction gas at a pressure of from 0.01 to 1000 bar. Typically the pressure is from 0.1 to 10 bar. The powder is then heated in the vessel in the presence of the gas to a temperature in the range 300° to 800° C., preferably in the range 400° to 650° C., and most preferably about 500° C. for a period sufficient to permit diffusion of the element to be incorporated into the interstitial sites throughout each grain of powder. The heating time may be anything up to 100 hours but a suitable period can be readily determined from the diffusion constants of the interstitial atoms in the intermetallic compound. A typical heating period is from 2 to 10 hours.

Except in the case where the interstitial element to be incorporated is oxygen it is preferable if the starting materials are heated in the reaction gas in the substantial absence of oxygen.

Following heating the reactor vessel is evacuated to remove excess reaction gas before cooling or alternatively it may be purged with an inert gas. The cooled product can then be processed to form permanent magnets. In the case of $Sm_2Fe_{17}$ ingots, for example, it has been found advantageous to include in the cast ingot up to 5% by weight of an early transition metal additive. Suitable additives include niobium, zirconium or titanium. The additive suppresses the formation of alpha-Fe dendrites which occur because the phrase does not melt congruently. Without the additive the α-Fe phase, which tends to destroy coercivity in the interstitially modified material, may be removed by lengthy high temperature annealing at about 1000° C.

It is an advantage of the novel process of the invention that interstitial incorporation of an element such as carbon, for example into an intermetallic rare earth/iron compound can be brought about at a much lower temperature than the arc melting method used in EP-A-0397264. Further the gas phase process of the invention allows a higher level of interstitial incorporation to be achieved compared with the arc melting method. As a result the uniaxial anisotropy is much greater and the Curie temperatures significantly higher than materials produced by hitherto known methods.

By way of example Table I compares the properties of compounds of the formula $Sm_2Fe_{17}C_y$ made by the process described in EP-A-0397264 with compounds of that formula made by the process of the present invention.

Although the present invention has been described with reference to preferred embodiments, workers skilled in the art will recognize the changes may be made in form and detail without departing from the spirit and scope of the invention.

TABLE I

| | EP-A-0397264 | Process of present invention |
|---|---|---|
| Compound | $Sm_2Fe_{17}C_y$ | $Sm_2Fe_{17}C_y$ |
| Range made | $0.5 < y' < 1.5$ | $0.5 < y' < 2.8$ |
| Tc (maximum) | 540 K | 673 K |
| Ba (maximum) | 4.0–5.3 T | 16 T |
| Process | Arc melting of elements | Heating in hydrocarbon gas |

From the above table the improvement in magnetic properties of the compounds produced by the process of the invention is readily apparent.

The effect of interstitial incorporation of carbon into compounds of the formula $R_2Fe_{17}$ on the crystal lattice parameters a(nm) c(nm), Curie temperature Tc(K), anistropy and magnetic moment M(μB/f.u) is shown in Table II below. h represents compounds of the hexagonal crystal structure and r compounds of the rhombohedral crystal structure. The composition of the carbides is $R_2Fe_{17}C_{y'}$ where y' is between 2.1 and 2.8.

TABLE II

| R | Structure | a(nm) | c(nm) | $T_c$(K) | Anisotropy | M($\mu_B$/f.u.) |
|---|---|---|---|---|---|---|
| Y | h | 0.866 | 0.840 | 668 | plane | 35.8 |
| Ce | r | 0.873 | 1.256 | 589 | plane | 33.8 |
| Pr | r | 0.880 | 1.259 | 653 | plane | 34.5 |
| Nd | r | 0.879 | 1.260 | 659 | plane | 35.1 |
| Sm | r | 0.875 | 1.257 | 668 | axis | 34.5 |
| Gd | r | 0.870 | 1.261 | 711 | plane | 20.1 |
| Tb | r | 0.867 | 1.264 | 680 | plane | 21.3 |
| Dy | h | 0.865 | 0.842 | 674 | plane | 17.1 |
| Ho | h | 0.861 | 0.843 | 672 | plane | 17.5 |
| Er | h | 0.860 | 0.841 | 663 | $T_{sr}$ = 124 k | 17.9 |
| Tm | h | 0.860 | 0.843 | 656 | $T_{sr}$ = 226 K | 21.2 |
| Lu | h | 0.857 | 0.842 | 657 | plane | 36.4 |

The effect on magnetic properties and crystal lattice parameters of interstitial incorporation of carbon into compounds of the formula $RFe_{11}Ti$ is shown in Table III below. In the table the value of y is between 0.6 and 0.9. In preferred compounds the value of y is 0.8.

Figure 1A:
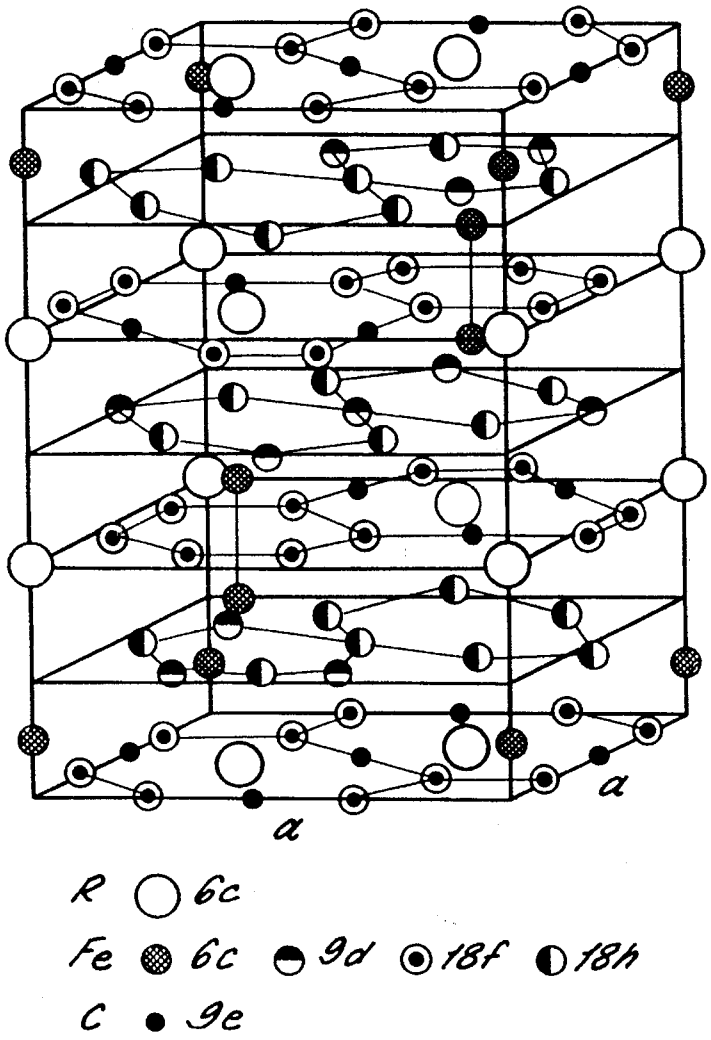
Figure 2:
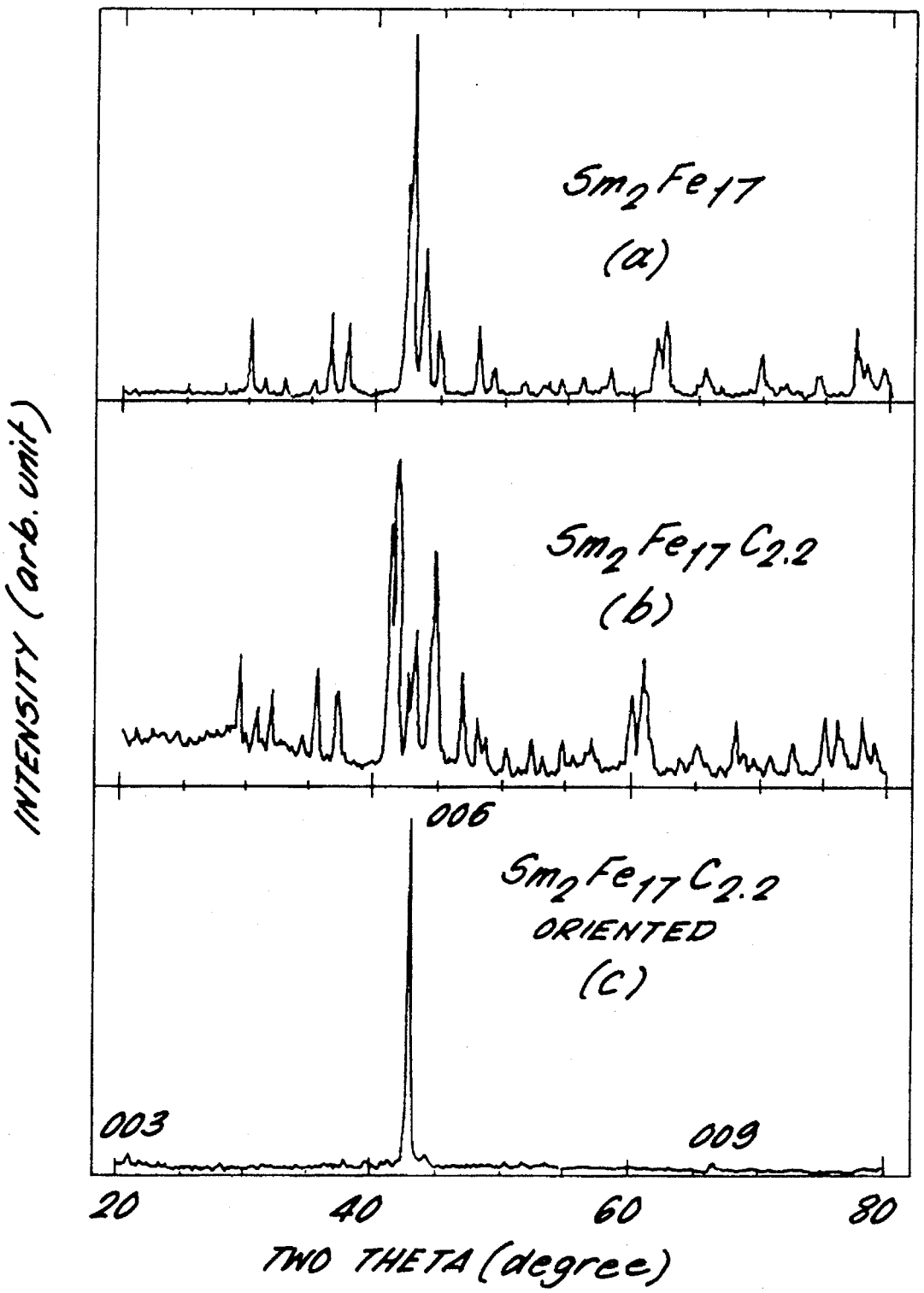
FIG. 2 shows: (a) X-ray defraction patterns of $Sm_2Fe_{17}$ powder before treatment in methane for two hours at 550° C.
Figure 3:
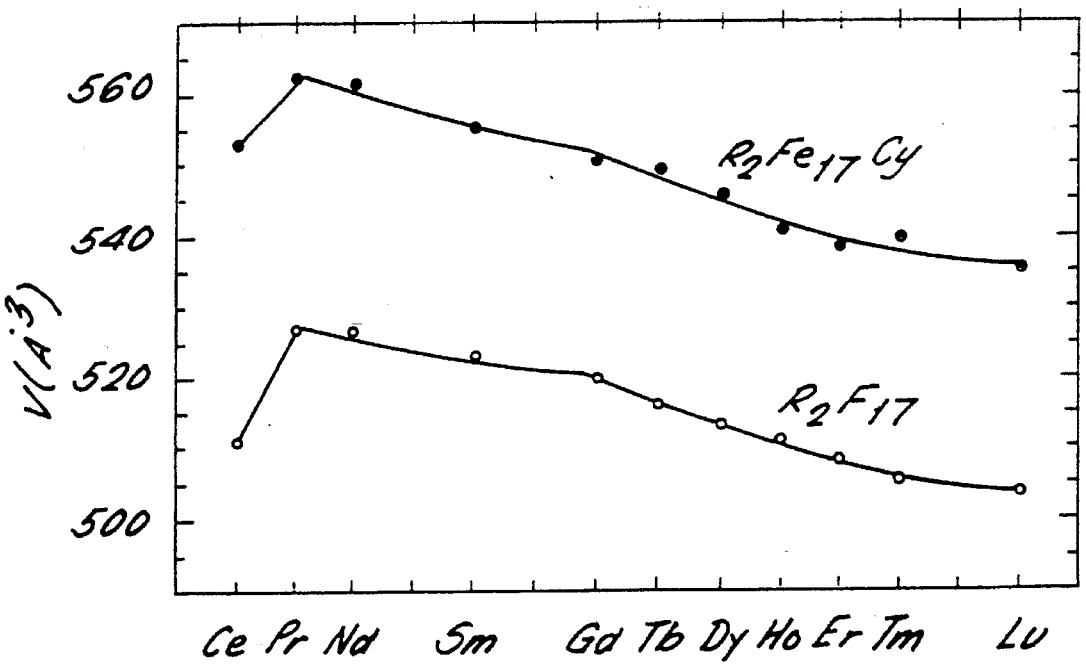
FIG. 3 shows the difference in unit cell volume between compounds having the formula $R_2Fe_{17}Cy'$ where $1.5<y'<3.0$ and those having the formula $R_2Fe_{17}$ where R is Ce, Pr, Nd, Sm, Gd, Tb, Dy, Ho, Er, Tm, or Lu.
Figure 4:
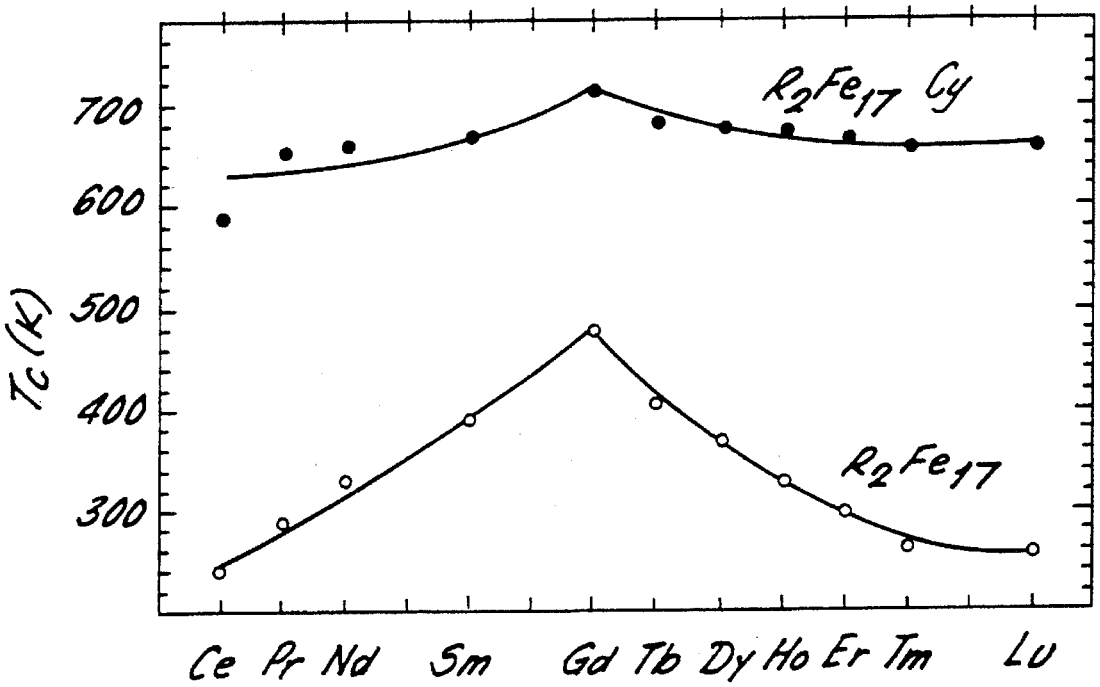
FIG. 4 shows the Curie temperature of compounds of the formula $R_2Fe_{17}Cy'$ where $1.5<y'<3.0$ and $R_2Fe_{17}$ where R is Ce, Pr, Nd, Sm, Cd, Tb, Dy, Ho, Er, Tm, or Lu.

FIG. 1(*a*) shows the rhombohedral crystal structure of $Sm_2Fe_{17}C_y'$ where the 9e site is occupied by carbon and FIG. 1(*b*) shows the tetragonal crystal structure of $Nd(Fe_{11}Ti)C_y$ showing the 2b site occupied by carbon;

FIG. 2 shows X-ray diffraction patterns of $Sm_2Fe_{17}$ powder (a) before (b) after treatment in methane for 2 hours at 550° C. and (c) after treatment and orientation in a magnetic field of 0.3T. In FIG. 2(*b*) a lattice expansion of about 6% is apparent after interstitial corporation of carbon and in FIG. 2(*c*) easy c-axis anisotropy is shown after orientation;

FIG. 3 shows the difference in unit cell volume between compounds having the formula $R_2Fe_{17}C_y'$ where $1.5<y'<3.0$ and those having the formula $R_2Fe_{17}$ where R is Ce, Pr, Nd, Sm, Gd, Tb, Dy, Ho, Er, Tm or Lu. A substantial increase in unit cell volume is observed for those compounds having the formula $R_2Fe_{17}C_y'$;

FIG. 4 shows the Curie temperature of compounds of the formula $R_2Fe_{17}C_y'$ where $1.5<y'<3.0$ and $R_2Fe_{17}$ where R is Ce, Pr, Nd, Sm, Cd, Tb, Dy, Ho, Er, Tm or Lu. A substantial increase in Curie temperature is observed for those compounds having the formula $R_2Fe_{17}C_y'$;

TABLE III

| | a(nm) | c(nm) | V(nm)$^2$ | ΔV/V (%) | $T_c$(K) | $\Delta T_c/T_c$ (%) | $M_s$($\mu_B$/f.u.) 42 K | $M_s$($\mu_B$/f.u.) 273 K | Anisotropy at 300 K |
|---|---|---|---|---|---|---|---|---|---|
| $Y(Fe_{11}Ti)$ | 0.851 | 0.479 | 0.347 | — | 524 | — | 19.0 | 16.6 | axis |
| $Y(Fe_{11}Ti)C_y$ | 0.857 | 0.481 | 0.353 | 1.7 | 678 | 29.4 | 19.4 | 14.8 | axis |
| $Nd(Fe_{11}Ti)$ | 0.857 | 0.478 | 0.351 | — | 547 | — | ? | 16.8 | axis |
| $Nd(Fe_{11}Ti)C_y$ | 0.862 | 0.482 | 0.358 | 2.0 | 670 | 22.5 | 18.9 | 19.2 | axis |
| $Sm(Fe_{11}Ti)$ | 0.855 | 0.479 | 0.350 | — | 584 | — | ? | 17.1 | axis |
| $Sm(Fe_{11}Ti)C_y$ | 0.858 | 0.480 | 0.353 | 0.9 | 698 | 19.5 | 16.9 | ? | plane |
| $Gd(Fe_{11}Ti)$ | 0.854 | 0.480 | 0.350 | — | 607 | — | ? | 12.5 | axis |
| $Gd(Fe_{11}Ti)C_y$ | 0.856 | 0.480 | 0.352 | 0.6 | 734 | 20.9 | 14.4 | 11.9 | axis |
| $Tb(Fe_{11}Ti)$ | 0.851 | 0.479 | 0.347 | — | 552 | — | 9.7 | 10.6 | axis |
| $Tb(Fe_{11}Ti)C_y$ | 0.857 | 0.481 | 0.353 | 1.7 | 714 | 29.3 | 10.9 | 11.3 | axis |
| $Dy(Fe_{11}Ti)$ | 0.849 | 0.478 | 0.344 | — | 534 | — | 9.7 | 11.6 | axis |
| $Dy(Fe_{11}Ti)C_y$ | 0.857 | 0.479 | 0.352 | 2.3 | 697 | 30.5 | 8.7 | 9.5 | axis |
| $Ho(Fe_{11}Ti)$ | 0.849 | 0.479 | 0.345 | — | 520 | — | ? | ? | axis |
| $Ho(Fe_{11}Ti)C_y$ | 0.855 | 0.479 | 0.350 | 1.4 | 691 | 32.9 | 8.0 | 8.9 | axis |
| $Er(Fe_{11}Ti)$ | 0.848 | 0.479 | 0.344 | — | 505 | — | 9.2 | 12.4 | axis |
| $Er(Fe_{11}Ti)C_y$ | 0.856 | 0.479 | 0.351 | 2.0 | 685 | 35.6 | 10.7 | 12.6 | axis |
| $Tm(Fe_{11}Ti)$ | 0.847 | 0.478 | 0.343 | — | 496 | — | ? | ? | axis |
| $Tm(Fe_{11}Ti)C_y$ | 0.855 | 0.478 | 0.349 | 1.7 | 686 | 38.3 | 15.5 | 17.9 | axis |
| $Lu(Fe_{11}Ti)$ | 0.846 | 0.478 | 0.342 | — | 488 | — | 17.4 | 15.5 | axis |
| $Lu(Fe_{11}Ti)C_y$ | 0.855 | 0.478 | 0.349 | 2.0 | 682 | 39.7 | 16.8 | 16.0 | axis |

The effect on magnetic properties of interstitial incorporation of boron into $Sm_2Fe_{17}$ and of carbon into $Nd(Fe_{11}Ti)$ are shown in Table IV below.

TABLE IV

| | $T_c$(°C.) | $\mu_o M_s$(T) | $B_a$(T) |
|---|---|---|---|
| $Sm_2Fe_{17}$ | 116 | 1.17 | easy plane |
| $Sm_2Fe_{17}C_{2.2}$ | 395 | 1.46 | 14 T |
| $Sm_2Fe_{17}B_{1.6}$ | 325 | 1.40 | >5 T |
| $Nd(Fe_{11}Ti)$ | 274 | 1.28 | 1 T |
| $Nd(Fe_{11}Ti)C_{0.7}$ | 397 | 1.32 | 7 T |

Figure 5:
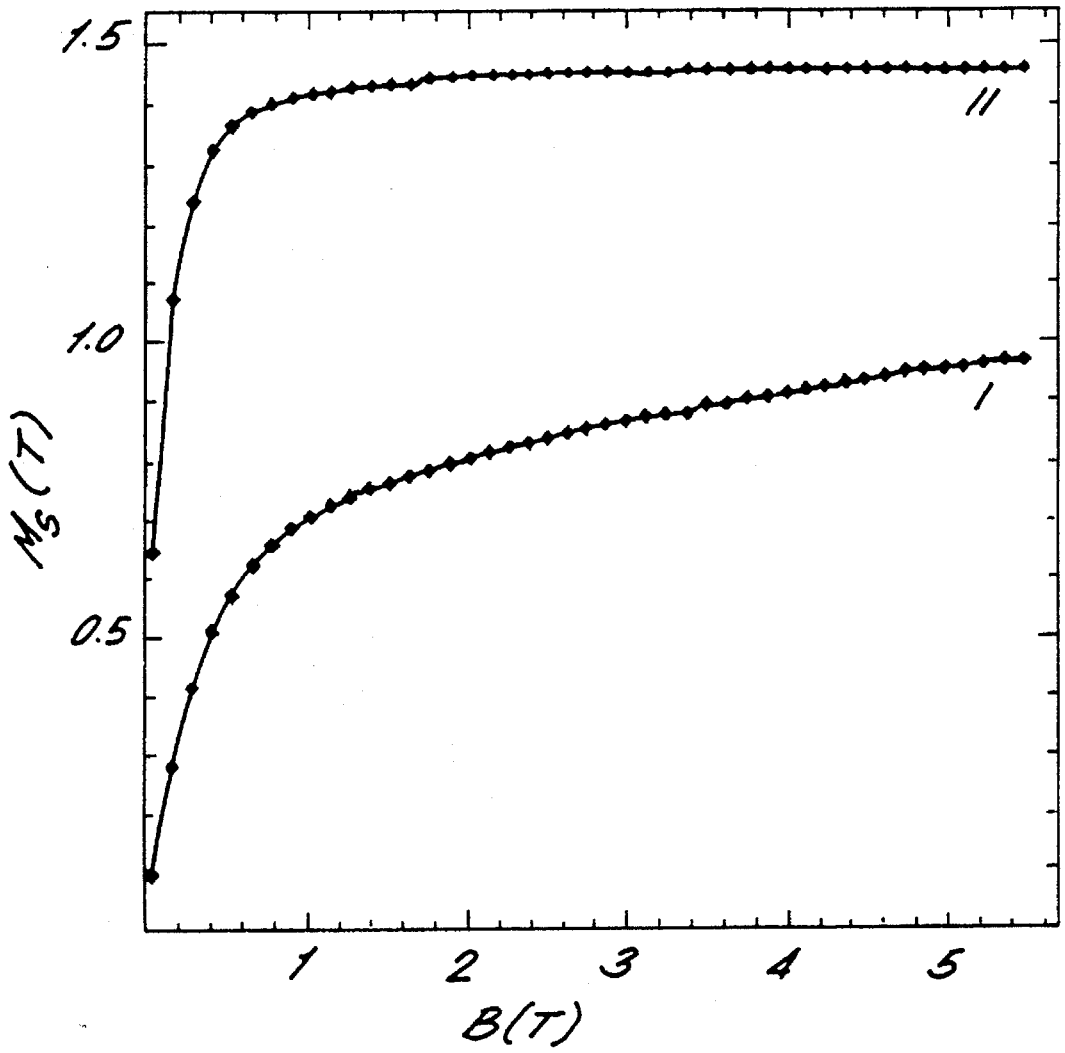
FIG. 5 shows magnetization curves at room temperature of a powder of $Sm_2Fe_{17}Cy'$ where $1.5<y'<3.0$, magnetically aligned in an applied field of 1T and fixed in epoxy resin.
Figure 6:
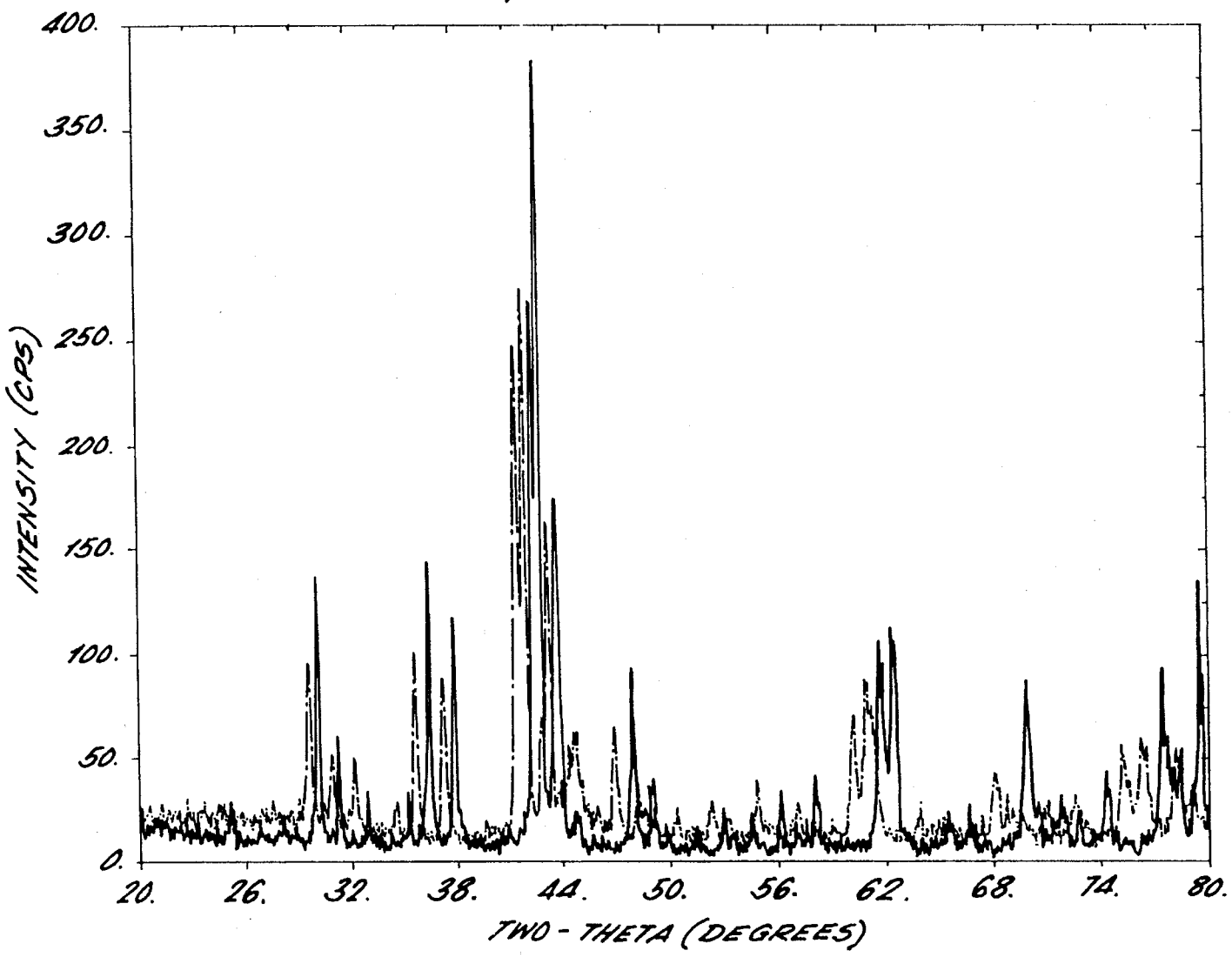
FIG. 6 shows X-ray diffraction patterns of $Sm_2Fe_{17}$ before treatment (solid line) and after treatment (broken line) at 475° C. for two hours in benzene vapor.
Figure 7:
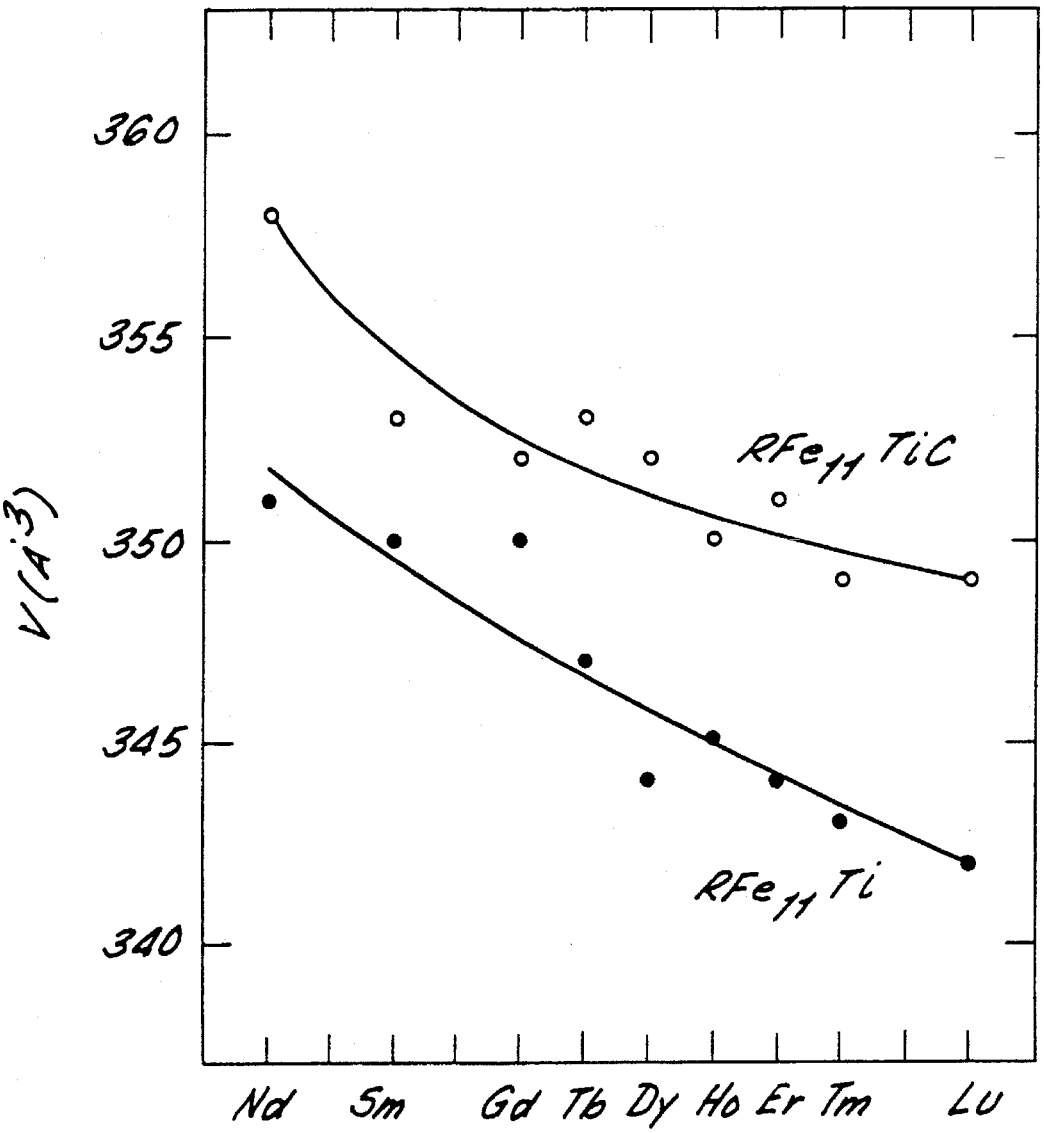
FIG. 7 shows the difference in cell unit volume between compounds having the formula $R(Fe_{11}Ti)$ and compounds having the formula $R(Fe_{11}Ti)Cy$, where is $0.6<y<0.9$ and where R is Ce, Dr, Nd, Sm, Gd, Tb, Dy, Ho, Er, Tm, or Lu.
Figure 8:
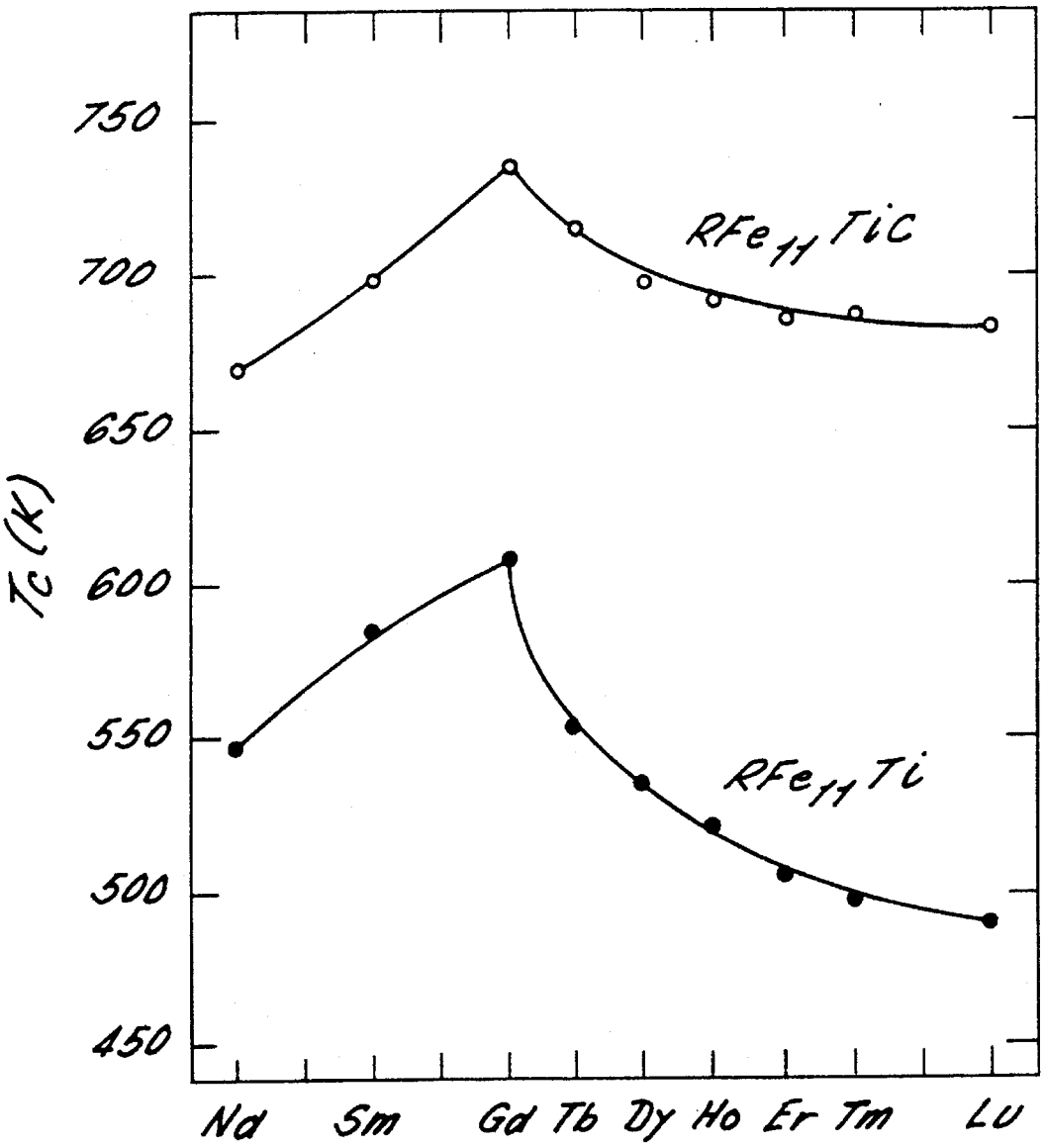
FIG. 8 shows the Curie temperatures of compounds of the formula $R(Fe_{11}Ti)$ and $R(Fe_{11}Ti)Cy$ where $0.6<y<0.9$ prepared by the process of the present invention where R is Ce, Pr, Nd, Sm, Gd, Tb, Dy, Ho, Er, Tm, or Lu.
Figure 9:
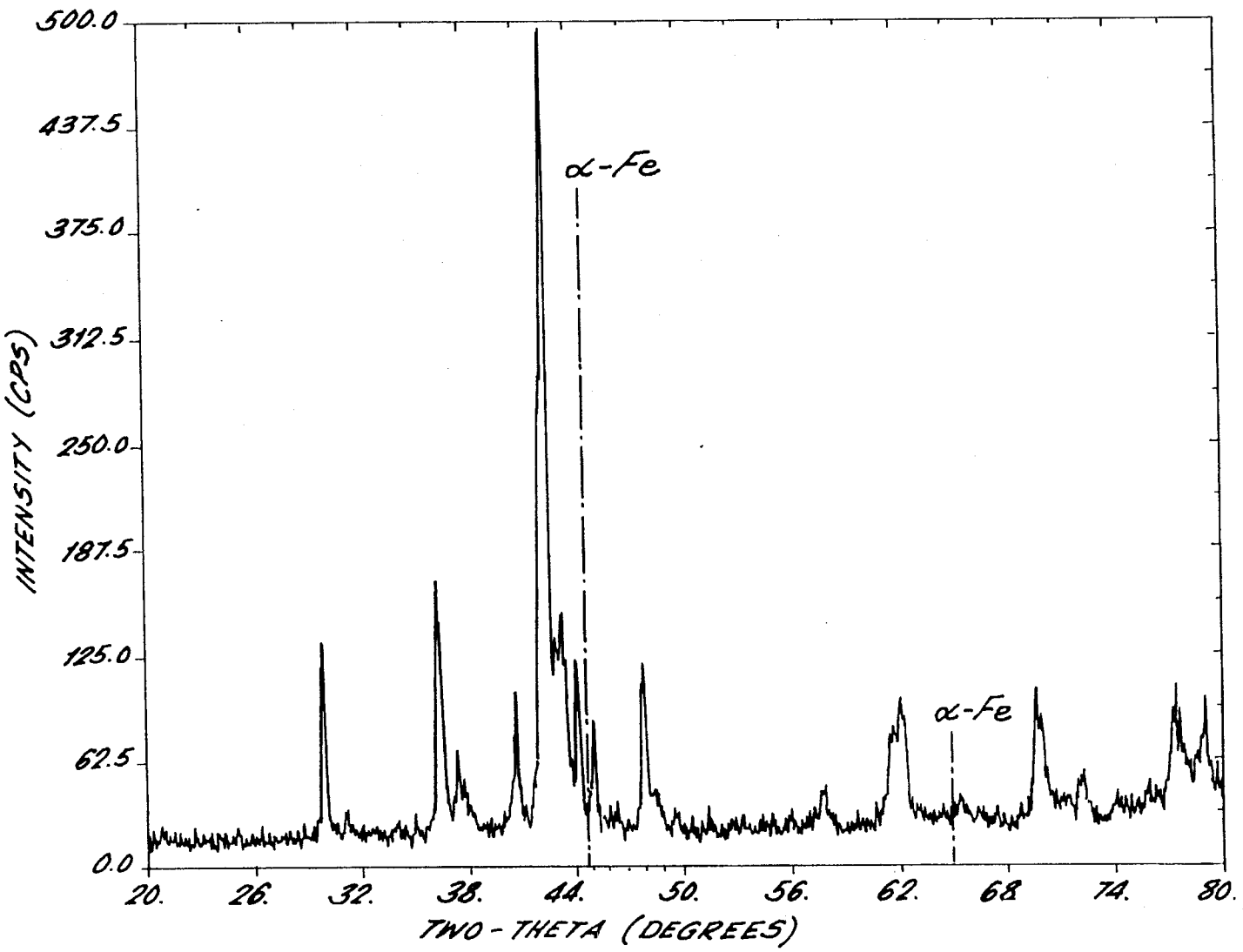
FIG. 9 shows X-ray diffraction pattern of an arc-melted and unannealed $Sm_2Fe_{17}$ ingot containing 5% weight Nb showing a substantial absence of free iron.

The interstitial incorporation of an element of Group IVA of the Periodic Table, for which the example is carbon, into selected intermetallic compounds of the formula $R_2Fe_{17}$ or $RFe_{11}Ti$ and the altered properties achieved thereby are further demonstrated in the figures in which:

FIG. 5 shows magnetization curves at room temperature of powder of $Sm_2Fe_{17}C_y'$ where $1.5<y'<3.0$ magnetically aligned in an applied field of 1T and fixed in epoxy resin. The anisotropy field deduced from the data shown in FIG. 5 is 16T;

FIG. 6 shows X-ray diffraction patterns of $Sm_2Fe_{17}$ before treatment (solid line) and after treatment (broken line) at 475° C. for 2 hours in benzene vapour showing a lattice expansion of 5.5%;

FIG. 7 shows the difference in cell unit volume between compounds having the formula $R(Fe_{11}Ti)$ and compounds having the formula $R(Fe_{11}Ti)C_y$ where y is $0.6<y<0.9$ and where R is Ce, Dr, Nd, Sm, Gd, Tb, Dy, Ho, Er, Tm or Lu. A substantial increase in unit cell volume is observed where carbon has been interstitially incorporated by heating in butane;

FIG. 8 shows the Curie temperatures of compounds of the formula $R(F_{11}Ti)$ and $R(Fe_{11}Ti)C_y$ where $0.6<y<0.9$ prepared by the process of the invention and where R is Ce, Pr, Nd, Sm, Gd, Tb, Dy, Ho, Er, Tm or Lu. Again a substantial increase in Curie temperature is observed where carbon has been interstitially incorporated;

FIG. 9 shows the X-ray diffraction pattern of an arc-melted and unannealed $Sm_2Fe_{17}$ ingot containing 5% weight Nb, showing a substantial absence of free iron. The solid line is the trace of the $Sm_2Fe_{17}$ ingot with additive and the broken lines indicate where the α-Fe peak would appear in an ingot without additive.

Figure 10:
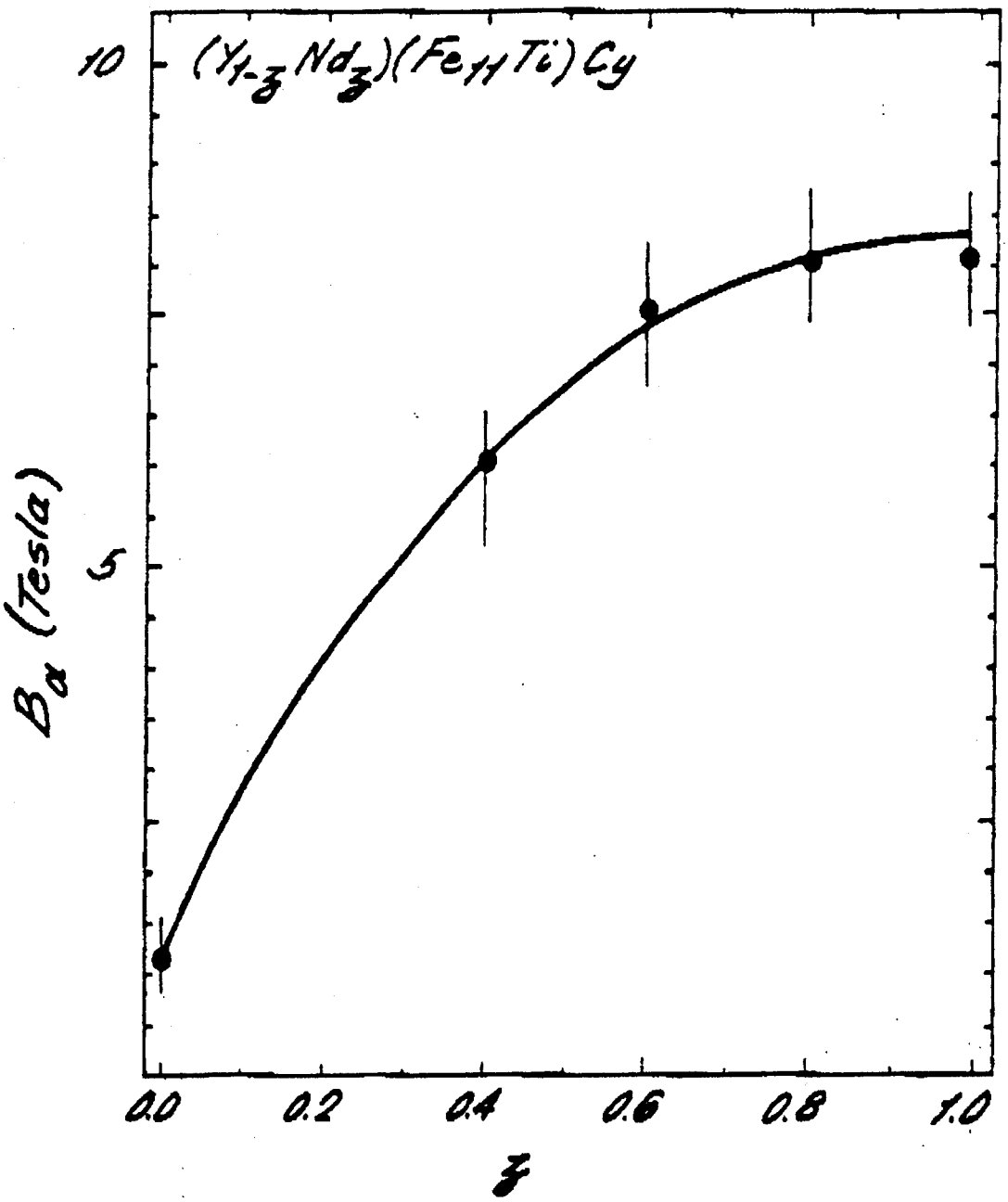
FIG. 10 shows the variation of anisotropy field as a function of neodymium content for the series of compounds $Y_{1-z}Nd_z)(Fe_{11}Ti)C_{0.8}$.

FIG. 10 shows the variation of anisotropy field as a function of neodymium content for the series of compounds $Y_{1-z}Nd_z)(Fe_{11}Ti)C_{0.8}$.

It will be readily apparant from the data presented herein that the process of the invention has substantial advantages over hitherto known processes for bringing about interstitial incorporation of another element into intermetallic magnetic compounds of the rare-earth/iron type and that the materials produced thereby have improved magnetic properties. Specifically the increase in Curie temperature, the uniaxial anisotropy and increase in spontaneous magnetization make the compounds of the invention very well suited for the manufacture of permanent magnets. The high Curie temperatures of these materials means that magnets made from them can be used in apparatus or processes requiring high temperature conditions and the magnetization of the magnet will not be lost.

Magnets may be formed from the materials of the invention by orienting the interstitially modified intermetallic compound in powder form in a magnetic field with a polymer resin to make a polymer-bonded magnet. More specifically the powder of the interstitially-modified intermetallic compound may optionally be milled to a finer powder, with particle size of 10 μm or less and then mixed with a polymeric material (e.g. a thermosetting resin or an epoxy resin) and optionally oriented in a magnetic field sufficient to align the easy axes of the grains of powder. The resin is then set and the composite is subject to a large magnetizing field sufficient to saturate the remanent magnetization.

In a modification of this process, the composite may be formed into a desired shape by compression or injection moulding, prior to applying the magnetizing field.

An alternative is to make the composite with a metal matrix rather than a polymer matrix. In this case, a low-melting point metal, such as Zn, Sn or Al, or a low-melting alloy, such as a solder may be used. The metal is mixed with the milled intermetallic powder, which may be oriented in a magnetic field prior to heat treatment at a temperature sufficient to melt the metal and form a metal-metal composite. The preferred metal is zinc, which reacts with any free αFe to form a nonmagnetic Fe-Zn alloy, thereby enhancing the coercivity of the magnet.

A further way in which magnets can be formed from the materials is to forge with a soft metal under a stress which tends to mechanically orient the crystallites of the material. In particular a shear stress is applied to the intermetallic powder, which is optionally mixed with a soft metal such as Al. The shear stress aligns the c-axes of the intermetallic crystallites and thereby increases the remanent magnetization of the magnet.

What is claimed is:

1. A process for modifying the magnetic properties of an intermetallic compound having interstitial sites, the process comprising:

providing the intermetallic compound, the intermetallic compound comprising:

lanthanum, cerium, praseodymium, neodymium, promethium, samarium, curopium, gadolinium, terbium, dysprosium, holmium, erbium, thulium, ytterbium, lutetium, yttrium, thorium, hafnium, zirconium, or a combination of any two or more of these; and one or more of the group consisting of iron, and a combination of iron with at least one transition metal;

heating said intermetallic compound in a reaction gas containing at least one element selected from groups IIIA, IVA or VIA of the CAS Periodic Table; and incorporating said element or elements of group IIIA, IVA or VIA of the CAS Periodic Table throughout said intermetallic compound at the interstitial sites.

2. A process as claimed in claim 1 wherein the intermetallic compound has the general formula:

$$R(T_{n-x}M_x)$$

wherein R is lanthanum, cerium, praseodymium, neodymium, promethium, samarium, europium, gadolinium, terbium, dysprosium, holmium, erbium, thulium, ytterbium, lutetium, yttrium, thorium, hafnium, zirconium, or a combination of any two or more of these, T is iron or a combination of iron with one or more transition metals, M is an element selected from the group consisting of groups IVB, VB and VIB of the CAS Periodic Table, n is approximately 12 and $0.5<x<3.0$.

3. A process as claimed in claim 1 wherein the intermetallic compound has the general formula:

$$R'_2(T'_{n-x}M'_x)$$

in which R' is lanthanum, cerium, praseodymium, neodymium, promethium, samarium, europium, gadolinium, terbium, dysprosium, holmium, erbium, thulium, ytterbium, lutetium, yttrium, thorium, hafnium, zirconium, or a combination of any two or more of these, T' is iron, M' is one or more transition metals, n is approximately 17 and $0\leqq x'<6.0$.

4. A process as claimed in claim 2 wherein R is selected from a group consisting of yttrium, cerium, praseodymium, neodymium, samarium, gadolinium, terbium, dysprosium, holmium, erbium, thulium and lutetium or is a mixture of two or more thereof.

5. A process as claimed in claim 3 wherein R' is selected from a group consisting of yttrium, cerium, praseodymium, neodymium, samarium, gadolinium, terbium, dysprosium, holmium, erbium, thulium and lutetium or is a mixture of two and more thereof.

6. A process as claimed in claim 2 wherein R is neodymium or praseodymium or a combination of neodymium or praseodymium with lanthanum, cerium, praseodymium, neodymium, promethium, samarium, curopium, gadolinium, terbium, dysprosium, holmium, erbium, thulium, ytterbium, lutetium, yttrium, thorium, hafnium, zirconium, or any two or more of these.

7. A process as claimed in claim 3 wherein R' is samarium or samarium in combination with cerium, praseodymium, neodymium, samarium, gadolinium, terbium, dysprosium, holmium, erbium, thulium, lutetium, yttrium, or any two or more of these.

8. A process as claimed in claim 2 wherein the iron is in combination with one or more of cobalt, nickel or manganese.

9. A process as claimed in claim 2 wherein M is selected from a group consisting of titanium, vanadium, molybdenum, tungsten and chromium.

10. A process as claimed in claim 3 wherein M' is cobalt, nickel or manganese or a combination of two or more thereof.

11. A process as claimed in claim 1 wherein the element of group IIIA, IVA or VIA of the CAS Periodic Table which is interstitially incorporated into the intermetallic compound is selected from a group consisting of boron, carbon, silicon, germanium, sulphur, selenium and tellurium or is a combination of two or more thereof.

12. A process as claimed in claim 1 wherein, except in the case where the element to be interstitially incorporated is oxygen, the intermetallic starting material is heated in the reaction gas in the substantial absence of oxygen.

13. A process as claimed in claim 10 wherein the element of group IVA which is interstitially incorporated is carbon and the reaction gas is a hydrocarbon.

14. A process as claimed in claim 13 wherein the reaction gas is methane, a $C_2$ to $C_5$ alkane, alkene or alkyne or an aromatic hydrocarbon.

15. A process as claimed in claim 13 wherein the interstitially modified compound produced has the formula:

$$Sm_2Fe_{17}C_y'$$

wherein $0.5<y<3.0$.

16. A process as claimed in claim 13 wherein the interstitially modified compound produced has the formula:

$$PrFe_{11}TiC_y \text{ or } NdFe_{11}TiC_y$$

wherein $0.5<y\leqq 1.0$.

17. A process as claimed in claim 10 wherein the element of group IIIA which is interstitially incorporated is boron and the reaction gas is borane or decaborane.

18. A process as claimed in claim 17 wherein an interstitially modified compound produced has the formula:

$$Sm_2Fe_{17}By' \text{ wherein } 0.5<y'<3.0.$$

19. A process as claimed in claim 10 wherein the element of group IVA which is interstitially incorporated is silicon and the reaction gas is a silane.

20. A process as claimed in claim 10 wherein the element of group VIA which is interstitially incorporated is sulphur and the reaction gas is hydrogen sulphide.

21. A process as claimed in claim 1 wherein the intermetallic compound is ground to a powder having a particle size of less than 50 microns diameter prior to heating in the reaction gas.

22. A process as claimed in claim 1 wherein the intermetallic compound has added up to 5% by weight of an early transition metal selected from the group consisting of groups IVB, VB and VIB of the CAS Periodic Table.

23. A process as claimed in claim 22 wherein the early transition metal is niobium, zirconium or titanium.

24. A process for modifying the magnetic properties of an intermetallic compound, the process comprising:

heating the intermetallic compound in a hydrocarbon gas to a temperature of from about 400° to about 650° C. at a pressure of 0.01 to 1000 bar to interstitially incorporate carbon into the crystal lattice of the intermetallic compound, the intermetallic compound comprising:

iron or a combination of iron with at least one transition metal; and one or more of the group consisting of lanthanum, cerium, praseodymium, neodymium, promethium, samarium, europium, gadolinium, terbium, dysprosium, holmium, erbium, thulium, ytterbium, lutetium, yttrium, thorium, hafnium, zirconium, and a combination of any two or more of these.

25. A modification of the process of claim 1 in which a powder of the interstitially modified intermetallic compound is magnetically or mechanically aligned and formed into a permanent magnet.

26. A modification as claimed in claim 25 wherein the permanent magnet is formed by:

(a) orienting the interstitially modified intermetallic compound in powder form in a magnetic field with a polymer resin to make a polymer-bonded magnet, or (b) orienting the interstitially modified intermetallic compound in powder form in a magnetic field, mixing with a low melting point metal or alloy and heating to form a metal-bonded magnet, or (c) forging the interstitially modified intermetallic compound in powder form with a soft metal under stress which magnetically orients crystallites of the interstitially modified intermetallic compound to form a metal-bonded magnet.

27. A process for modifying the magnetic properties of an intermetallic compound having interstitial sites, the process comprising:

providing the intermetallic compound, the intermetallic compound comprising:

lanthanum, cerium, praseodymium, neodymium, promethium, samarium, europium, gadolinium, terbium, dysprosium, holmium, erbium, thulium, ytterbium, lutetium, yttrium, thorium, hafnium, zirconium, or a combination of any two or more of these; and one or more of the group consisting of: iron and a combination of iron with at least one transition metal;

heating said intermetallic compound in a hydrocarbon gas to a temperature of from about 400° to about 650° C. at a pressure of 0.01 to 1000 bar; and incorporating carbon throughout said intermetallic compound at the interstitial sites.

28. A process for modifying the magnetic properties of an intermetallic compound having interstitial sites, the process comprising:

providing the intermetallic compound, the intermetallic compound comprising:

one or more of the group consisting of yttrium, cerium, praseodymium, neodymium, samarium, gadolinium, terbium, dysprosium, holmium, erbium, thulium, lutetium and a mixture of two or more of these; and one or more of the group consisting of iron, and a combination of iron with at least one transition metal; and heating the intermetallic compound in a reaction gas containing at least one element selected from groups IIIA, IVA or VIA of the CAS Periodic Table; and incorporating the element or elements of group IIIA, IVA or VIA of the CAS Periodic Table throughout the intermetallic compound at the interstitial sites.

29. A process as claimed in claim 28 wherein the intermetallic compound has the general formula:

$$R(T_{n-x}M_x)$$

wherein R is selected from a group of elements consisting of yttrium, cerium, praseodymium, neodymium, samarium, gadolinium, terbium, dysprosium, holmium, erbium, thulium, lutetium, and a mixture of two or more of these elements, T is iron or a combination of iron with one or more transition metals, M is an element selected from the group consisting of groups IVB, VB and VIB of the CAS Periodic Table, n is approximately and $0.5<x<3.0$.

30. A process as claimed in claim 28 wherein the intermetallic compound has the general formula:

$$R'_2(T'_{n-x}M'_x)$$

wherein R' is selected from a group of elements consisting of yttrium, cerium, praseodymium, neodymium, samarium, gadolinium, terbium, dysprosium, holmium, erbium, thulium, lutetium and a mixture of two or more of these elements, T' is iron, M' is one or more transition metals, n is approximately 17 and $0\leqq x'<6.0$.

31. A process as claimed in claim 29 wherein R is neodymium or praseodymium or a combination of neodymium or praseodymium with one or more elements selected from the group consisting of yttrium, cerium, samarium, gadolinium, terbium, dysprosium, holmium, erbium, thulium and lutetium.

32. A process as claimed in claim 30 wherein R' is samarium or samarium in combination with one or more elements selected from the group consisting of yttrium, cerium, praseodymium, neodymium, gadolinium, terbium, dysprosium, holmium, erbium, thulium and lutetium.

33. A process for modifying the magnetic properties of an intermetallic compound having interstitial sites, the process comprising:

providing the intermetallic compound, the intermetallic compound comprising:

one or more elements of the group consisting of yttrium, cerium, praseodymium, neodymium, samarium, gadolinium, terbium, dysprosium, holmium, erbium, thulium, lutetium and a mixture of two or more of these elements; and one or more elements of the group consisting of iron and a combination of iron with at least one transition metal;

heating the intermetallic compound in a hydrocarbon gas to a temperature of from about 400° to about 650° C. at a pressure of 0.01 to 1000 bar; and incorporating carbon throughout the intermetallic compound at the interstitial sites.

* * * * *

UNITED STATES PATENT AND TRADEMARK OFFICE

CERTIFICATE OF CORRECTION

PATENT NO. : 5,478,411

DATED : December 26, 1995

INVENTOR(S) : JOHN M.D. COEY; HONG SUN; DAVID P. HURLEY

It is certified that error appears in the above-indentified patent and that said Letters Patent is hereby corrected as shown below:

Col. 1, line 46, after "Company.", delete "."

Col. 2, line 16, delete "arc"

Col. 4, line 64, delete "M'", insert --M"--

Col. 6, line 63, delete "B", insert --$_\beta$

Col. 10, line 4, delete "curopium", insert --europium--

Col. 10, line 53, delete "curopium", insert --europium--

Col. 13, line 6, after "approximately", insert --$^{12}$--

Signed and Sealed this

Fourth Day of June, 1996

Bruce Lehman

*Attest:*

BRUCE LEHMAN

*Attesting Officer*

*Commissioner of Patents and Trademarks*